US007728519B2

(12) United States Patent
Koch et al.

(10) Patent No.: US 7,728,519 B2
(45) Date of Patent: Jun. 1, 2010

(54) CORRECTION OF THE DISTORTION OF AN IMAGE INTENSIFIER ELECTRON TUBE

(75) Inventors: Andreas Koch, Grenoble (FR); Daniel Gally, Bressieux (FR); Clément Vallois, Mirville (FR); Eric Marche, Coublevie (FR)

(73) Assignee: Thales (FR)

( * ) Notice: Subject to any disclaimer, the term of this patent is extended or adjusted under 35 U.S.C. 154(b) by 278 days.

(21) Appl. No.: 11/861,638

(22) Filed: Sep. 26, 2007

(65) Prior Publication Data

US 2008/0073492 A1 Mar. 27, 2008

(30) Foreign Application Priority Data

Sep. 26, 2006 (FR) ..... 06 08456

(51) Int. Cl.
*H01J 40/18* (2006.01)
*H01J 31/50* (2006.01)

(52) U.S. Cl. ..... 313/530; 313/103 CM; 250/214 VT

(58) Field of Classification Search ..... 313/530
See application file for complete search history.

(56) References Cited

U.S. PATENT DOCUMENTS

| | | | | |
|---|---|---|---|---|
| 5,338,927 | A * | 8/1994 | de Groot et al. | 250/214 VT |
| 6,194,700 | B1 * | 2/2001 | Pradere et al. | 250/214 VT |
| 6,960,879 | B2 * | 11/2005 | Koch et al. | 313/530 |
| 7,557,503 | B2 * | 7/2009 | Inagaki et al. | 313/530 |

FOREIGN PATENT DOCUMENTS

| | | |
|---|---|---|
| EP | 0554145 | 8/1993 |
| EP | 094965 | 10/1999 |
| WO | 02095477 | 11/2002 |

* cited by examiner

*Primary Examiner*—Peter Macchiarolo
(74) *Attorney, Agent, or Firm*—Lowe Hauptman Ham & Berner, LLP

(57) ABSTRACT

The invention relates to the correction of the distortion of an image intensifier electron tube comprising an entry screen intended to receive what is called primary electromagnetic radiation and an exit screen emitting radiation dependent on the primary radiation, the entry screen including a photocathode that emits an electron beam in the tube toward the exit screen, the emission of the electron beam being dependent on the primary radiation. The entry screen furthermore includes a test pattern formed from a plurality of dots distributed over the entry screen, the test pattern comprising means for locally altering the electron beam without altering the primary radiation.

14 Claims, 3 Drawing Sheets

CORRECTION OF THE DISTORTION OF AN IMAGE INTENSIFIER ELECTRON TUBE

RELATED APPLICATIONS

The present application is based on, and claims priority from, France Application Number 06 08456, filed Sep. 26, 2006, the disclosure of which is hereby incorporated by reference herein in its entirety.

BACKGROUND OF THE INVENTION

The invention relates to correction of the distortion of an image intensifier electron tube.

DESCRIPTION OF THE PRIOR ART

An image intensifier electron tube includes an entry screen, intended to receive what is called primary electromagnetic radiation, and an exit screen that emits radiation dependent on the primary radiation. Intensifiers are used for example in medical radiology. In this case, the intensifier receives X-ray radiation, which passes through the body of a patient. The intensifier emits, on its second screen, a visible image that depends on the X-ray radiation received by the entry screen. In addition to converting the X-ray radiation into visible radiation forming the visible image, the intensifier amplifies the intensity of the received image. In medical radiology, this amplification allows the dose of X-ray radiation received by the patient to be reduced. The amplification is achieved conventionally by converting the radiation received by the entry screen into electrons emitted in a cavity under vacuum. The electrons are then accelerated by means of electrodes and then converted by the exit screen into a visible image.

Of course, the invention is not limited to medical radiology—it may be employed in all types of intensifiers whatever the radiation received or emitted by the screens. The invention is for example applicable to light image intensifiers.

Use of electrons accelerated by electrodes makes the intensifier sensitive to electromagnetic interference occurring in the environment of the intensifier. This interference creates a spatial distortion of the image emitted by the exit screen relative to the image received by the entry screen.

This distortion is objectionable, for example when operations have to be carried out between several successive images, such as for example DSA (Digital Subtraction Angiography), which claims good superposition of the images to be subtracted despite possible changes in ambient magnetic field. Distortion correction is also important for reconstructing tomographic images by means of images taken in various views. In the latter use, the orientation of the tube is changed between two successive images, thereby running the risk of disturbing the path of the electrons, which are sensitive in particular to the Earth's magnetic field, which remains fixed.

Many nonmedical applications also require distortion reduction. Mention may be made of X-ray diffraction and all the control operations during which images are substrated in order to identify differences relative to a model.

It is possible to correct this distortion by placing in front of the entry screen a grid that lets through or stops, in precise regions, the radiation received by the entry screen. The image emitted by the exit screen may be analyzed in order to find, in the emitted image, the regions defined by the grid and thus determine, for each of the regions, the distortion of the image emitted by the exit screen compared with the image received by the entry screen. For each point in the received image, the distortion may then be determined by interpolation between the regions. When using the intensifier for receiving a useful image, it is of course necessary to move the grid away from the scene observed by the entry screen of the intensifier. It is thus possible to correct the useful image emitted by the exit screen using the distortion values determined for each point in the image.

By proceeding in this way, it is necessary to redetermine the distortion whenever the environment of the intensifier is modified, for example when an electrical machine is moved close to the intensifier or when the intensifier itself is moved. In medical radiology, the intensifier is frequently moved as it is often easier to move the X-ray source and the intensifier, rather than the patient himself. The use of a grid that is positioned in front of the entry screen to determine the distortion and then removed constitutes a tedious and tricky procedure to implement. The procedure is tedious as it requires a not inconsiderable amount of time to manipulate the grid. The procedure is tricky as it is necessary to control the positioning of the grid with respect to the entry screen very accurately.

Another solution consists in projecting onto the entry screen a luminous test pattern and in analyzing its distribution on the exit screen. This solution avoids having to move mechanical parts, such as the grid, but it nevertheless remains tedious to implement and requires interrupting the projection of the test pattern in order to produce a "useful" image. Moreover, it is difficult to ensure sufficient dimensional stability of this test pattern. In a standard case, it would be necessary to ensure a stability of the order of 10 μm in order for the precision of the test pattern to be better than the size of pixel in the case of digitizing the image obtained on the exit screen.

SUMMARY OF THE INVENTION

The object of the invention is to alleviate the abovementioned problems by proposing an intensifier tube in which the test pattern may be permanently present, without disturbing the primary radiation.

For this purpose, the subject of the invention is an image intensifier electron tube comprising an entry screen intended to receive what is called primary electromagnetic radiation and an exit screen emitting radiation dependent on the primary radiation, the entry screen including a photocathode that emits an electron beam in the tube toward the exit screen, the emission of the electron beam being dependent on the primary radiation, in which the entry screen furthermore includes a test pattern formed from a plurality of dots distributed over the entry screen, the test pattern comprising means for locally altering the electron beam without altering the primary radiation.

By not altering the primary radiation, it is possible to maintain a constant contrast of the test pattern on the secondary screen even in the case of a change of spectrum of the primary radiation. It has been found that by acting on the primary radiation, the contrast of the test pattern is modified, making it more difficult to remove the image test pattern observed on the exit screen of the tube. Changing the spectrum of the primary radiation is common in medical imaging. For example, when an X-ray source comprising a tube in which an electron beam bombards a target is used, modifying the voltage applied to electrodes that accelerate the electron beam results in a modification in the spectrum of the X-radiation. Another cause of modification of the X-radiation spectrum is due to the object that it is desired to image. More precisely, the thickness of a object (a patient in medical imaging) has an influence on the spectrum of the primary radiation received by the entry screen.

An alteration of the primary radiation is not in general independent of the spectrum of the primary radiation and it requires the tube to be recalibrated. The fact of not altering the primary radiation therefore makes it possible to avoid any recalibration between two successive images.

BRIEF DESCRIPTION OF THE DRAWINGS

The invention will be better understood and other advantages will become apparent on reading the detailed description of one embodiment given by way of example, the description being illustrated by the appended drawing in which.

For the sake of clarity, identical elements will bear the same reference numbers in the various figures.

DESCRIPTION OF THE PREFERRED EMBODIMENTS

Figure 1:
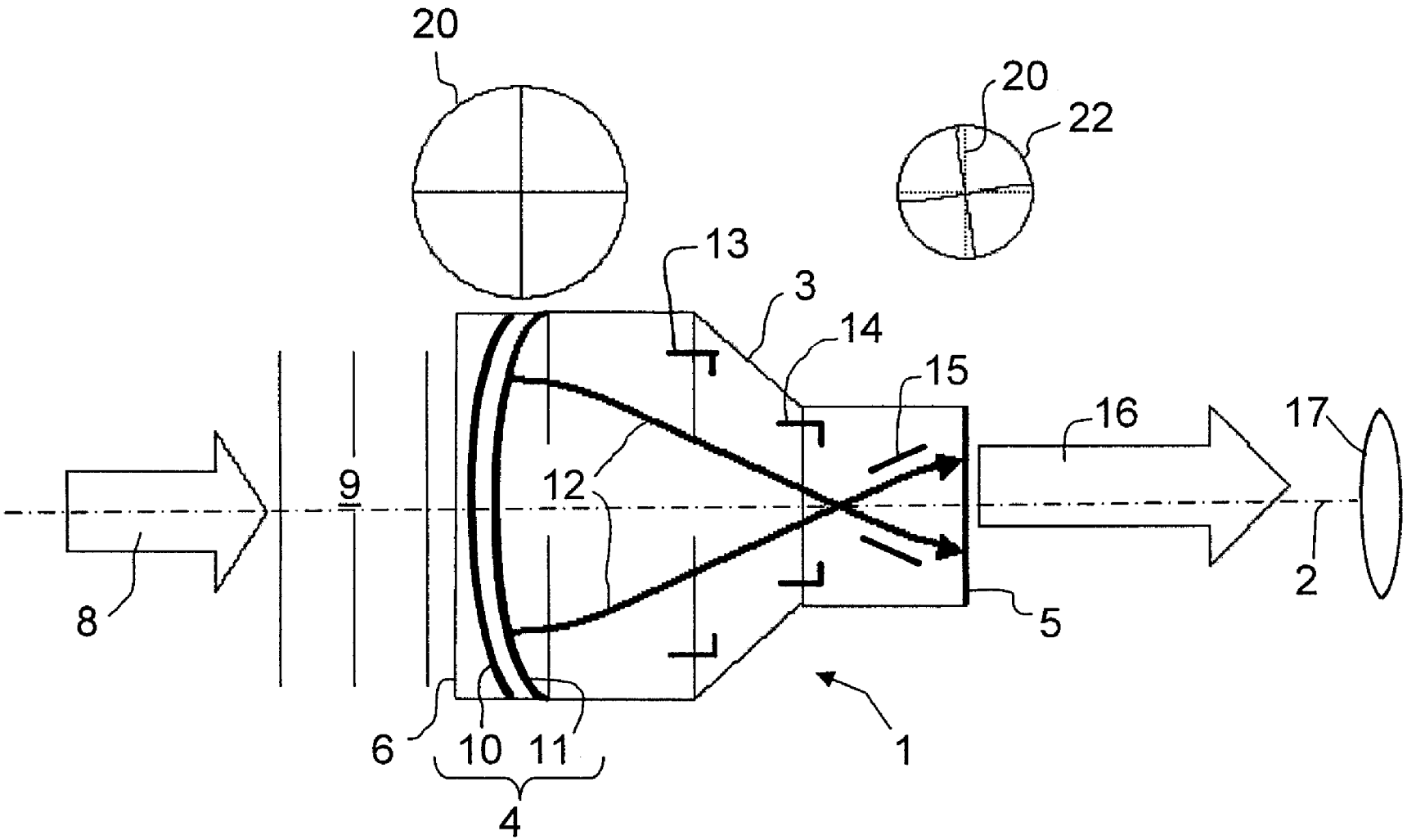
FIG. 1 shows schematically the main elements of an image intensifier electron tube.

FIG. 1 shows a tube 1 substantially elongate along an axis 2. The tube 1 comprises an envelope 3 in which there is a vacuum high enough for electrons to be able to travel therein. An entry screen 4 forms a first end of the envelope 3 and an exit screen 5 forms a second end of the envelope 3. An entry window 6 seals the envelope 3 at its first end. It is possible to dispense with the entry window 6 and, in this case, the first screen 4 seals the envelope at its first end. Likewise, the exit screen 5 may seal the envelope 3 at its second end.

X-ray radiation penetrates the tube 1 substantially along the axis 2 in a direction depicted by the arrow 8. This radiation passes through an object 9 a radiographic image of which it is desired to obtain. Downstream of the object 9, the primary, for example X-ray, radiation reaches the entry screen 4 by passing through the entry window 6. The entry screen 4 comprises a scintillator 10 on that face of the entry screen 4 receiving the X-ray radiation and a photocathode 11 on the opposite face of the entry screen 4. The scintillator 10 converts the primary radiation received by the entry screen 4 into secondary radiation, such as for example visible light. This secondary radiation is then absorbed by the photocathode 11, which converts it into electrons. The electrons are then emitted inside the envelope 3 toward the exit screen 5. The path of the electrons inside the envelope 3 is depicted schematically in FIG. 1 by arrows 12.

The tube 1 also includes several electrodes 13, 14 and an anode 15 that are located inside the envelope 3, for accelerating the electrons emitted by the photocathode 11 and for guiding them toward the exit screen 5. The acceleration of the electrons gives them energy for intensifying the image. The exit screen 5 receives the electrons emitted by the photocathode 11 and converts them into radiation, for example visible radiation, emitted to the outside of the envelope 3 in the direction of the arrow 16. This visible radiation may for example be analyzed by a camera, represented in FIG. 1 by its entry pupil 17. The optical axis of the entry public 17 is substantially coincident with an axis of the exit screen, in this case the axis 2.

Figure 2:
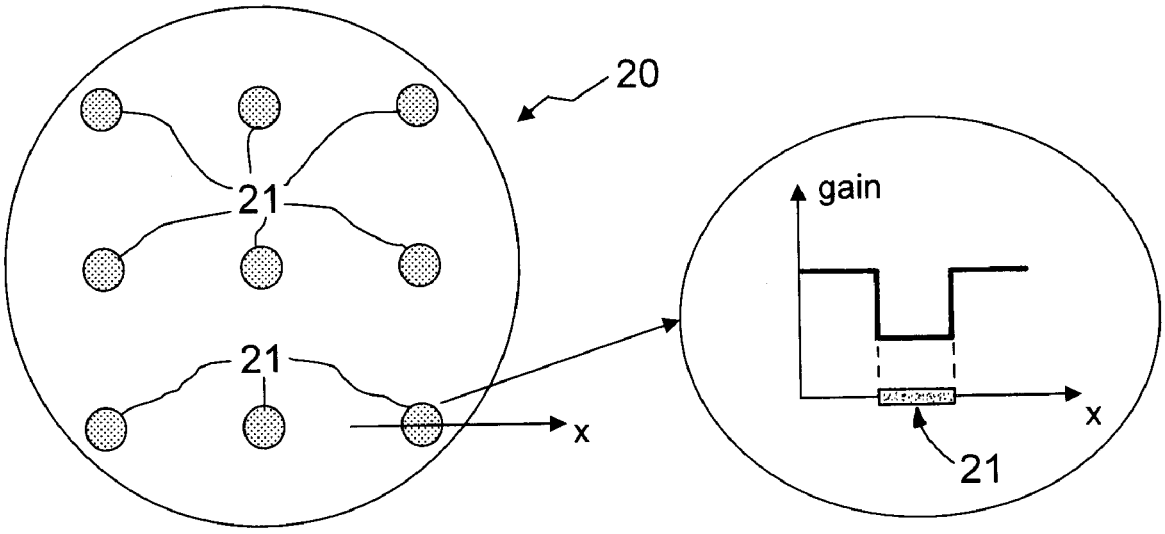
FIG. 2 shows an example of a test pattern produced on an entry screen of the tube.

FIG. 2 shows a test pattern 20 forming part of the entry screen 4. The test pattern 20 is formed by a plurality of dots 21 distributed over the entry screen 4. The dots 21 form for example an array uniformly distributed over the surface of the entry screen 4. The dots 21 are for example round, as shown in FIG. 2. Other shapes of dots are of course possible, such as for example a square shape. The test pattern 20 includes means for locally altering the secondary radiation, which for example modify the primary radiation/secondary radiation transfer function linearly. In other words, in each dot 21 of the test pattern 20, the gain between the secondary radiation and the primary radiation is increased or decreased. The modification of the gain is determined so that the dots 21 appear with sufficient contrast on the image obtained on the secondary screen 5 in the presence of an object 9 and under various X-ray radiation doses. Shown as an insert in FIG. 2 is an example of the variation in gain along an axis x passing through a dot 21 in the form of a curve. Outside the dot 21, the gain is a maximum and inside it the gain is reduced. Trials have shown that a reduction in gain of between 30 and 50% allows some of the dots 21 to be recognized within an image of the object 9.

Advantageously, the tube includes means for producing a light offset for the photocathode 11. This is because, at very low intensity of the primary radiation, the corpuscular noise of this radiation may be substantial and make the recognition of the dots 21 difficult if the noise-to-signal ratio is of the same order as the reduction in the gain by the dots 21. One remedy is to apply a light offset, that is to say a uniform luminous illumination of the photocathode 11. Advantageously, this illumination is applied via that face of the entry screen on the opposite side from that receiving the primary radiation, called the rear face of the entry screen 4. This light offset allows better detection of the dots 21. The offset is then subtracted from the images obtained on the secondary screen 5. The offset also has inherent corpuscular noise, but this is substantially lower than the corpuscular noise of the primary radiation. Of course, the offset noise must not exceed the primary radiation signal. The offset is for example applied by means of a beam emitted by a light-emitting diode uniformly illuminating the rear face of the entry screen 4.

During operation of the tube 1, the array of dots 21 is shifted nonuniformly owing to the influence of the magnetic fields. To illustrate this shift, an example of a test pattern 20 is shown in FIG. 1 above the entry screen 4. An image 22 of this test pattern 20, obtained on the exit screen 5, is shown by the continuous lines above the exit screen 5. In order for the distortion between the test pattern 20 and its image 22 to be clearly seen, an undistorted image of the test pattern 20 has been shown on the exit screen 5 as the broken lines superimposed on the image 22.

Advantageously, the tube 1 includes means for analyzing the distribution of the plurality of dots 21 received by the exit screen 5. More precisely, this distortion is measured by analyzing the distribution of the dots in the image 22 of the test pattern 20. For image points lying between the dots of the test pattern 20, the distortion may be determined by interpolation based on the measured distortion for the dots of the test pattern 20 closest to the point in question in the image 22. The measurement may be an absolute measurement and the analysis consists in comparing the distribution of the dots in the image 22 with a theoretical distribution. The measurement may be a relative measurement and, in this case, is compared with an image 22 formed during a calibration phase, during which the distortion of the image is controlled.

Advantageously, the means for locally altering the secondary radiation modifies the primary radiation/secondary radiation transfer function linearly. The transfer function is determined so as not to completely mask the primary radiation at the dots 21, in order to be able to recover the information contained in the primary radiation by suitable processing. More precisely, it was realized that, in the absence of the test pattern 20, the entry screen 4 and more precisely the primary radiation/secondary radiation conversion has essentially multiplicative gain discrepancies. In other words, the discrepancies already alter the primary radiation/secondary radiation transfer function linearly. It is known how to correct such discrepancies, for example by dividing an image referred to as the useful image, obtained when the X-ray radiation passes through an object 9, by a reference image obtained when the same X-ray radiation does not pass through any object. It is sufficient therefore to apply this type of correction in order to recover a useful image cleaned of the test pattern 20. Of course, this step of eliminating the test pattern 20 from the image takes place only after the geometrical distortion correction phase. These two image processing operations are for example carried out by digitizing the image obtained on the exit screen 5.

It is therefore chosen to produce the test pattern 20 by means of dots 21 that are semitransparent to the secondary radiation.

To ensure geometrical stability of the test pattern 20 on the entry screen 4, all of the means for producing the test pattern form part of the entry screen 4 and, more precisely, for each dot 21 of the test pattern 20, the means for locally altering the secondary radiation comprise a layer deposited on a surface of the entry screen 4. This layer may absorb or reflect the secondary radiation. It is in fact possible to increase the gain at the dot 21 instead of reducing it, as was explained by means of the insert of FIG. 2.

Figure 3:
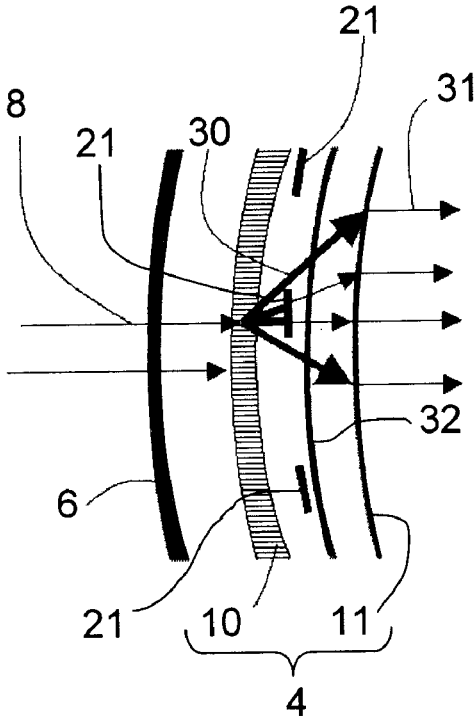
FIG. 3 illustrates the operation of dots of the test pattern.

FIG. 3 illustrates the operation of the dots 21 of the test pattern 20. In this figure may again be seen the entry screen 4, formed from the scintillator 10 and the photocathode 11, and the entry window 6. The primary radiation, the path of which is depicted by the arrows 8, passes through the entry screen 6 and is then converted into secondary radiation, the path of which is depicted by the arrows 30 terminating on the photocathode 11, which converts the secondary radiation into an electron beam 31. The dots 21 of the test pattern 20 are deposited on an intermediate layer 32, located between the scintillator 10 and the photocathode 11, and partly absorb the secondary radiation. In FIG. 3, the absorption is depicted by thin arrows 30 after the secondary radiation has passed through the dot 21.

Figure 4:
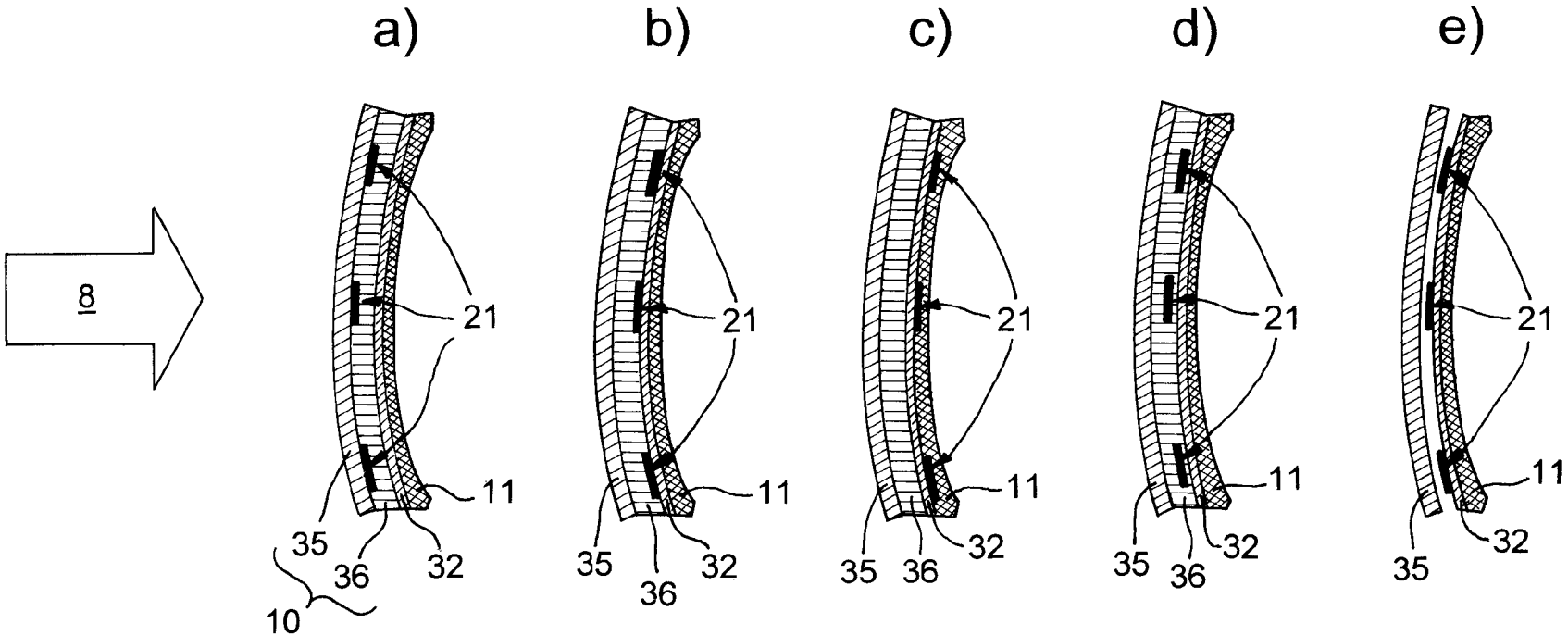
FIGS. 4*a* to 4*e* show various examples of the arrangement of the test pattern dots on an entry screen of the tube.

FIGS. 4*a*, 4*b* and 4*c* show several examples of arrangements of dots 21 of the test pattern 20 on an entry screen 4. These figures show the scintillator 10, the intermediate layer 32 and the photocathode 11. The scintillator 10 comprises a substrate 35 and a scintillating substance 36, for example based on cesium iodide. In FIG. 4*a*, the layer producing each dot 21 is deposited on the substrate 35 and more precisely on a face of the substrate 35 bearing the scintillating substance 36. The secondary radiation in the scintillating substance 36 is emitted partly rearward, that is to say in the opposite direction to that of the arrow 8. The layer forming each dot 21 may either reflect the rearwardly emitted part of the secondary radiation, and in this case the gain in the primary radiation/secondary radiation conversion is increased, or may absorb this part of the secondary radiation, and in this case reduce the reflection of the secondary radiation on the substrate 35 and thus reduce the gain of the conversion.

In FIGS. 4*b* and 4*c*, the layer forming each dot 21 is deposited on the intermediate layer 32 separating the scintillator 10 from the photocathode 11 either on the side facing the scintillator 10, the case shown in FIG. 4*b*, or on the side facing the photocathode 11, the case shown in FIG. 4*c*. In other words, the test pattern may be produced between the scintillator 10 and the intermediate layer 32 or between the intermediate layer 32 and the photocathode 11.

The intermediate layer 32 may comprise a conductive layer supplying the photocathode 11. The test pattern 20 may be produced inside this conductive layer. In this case, it is advantageous to provide one or more additional layers in order to prevent degradation of the photocathode 11 and/or of the conductive layer by the material of the test pattern 20.

In FIG. 4*d*, the dots 21 are produced inside the scintillating substance 36 so as to reduce the chemical interactions, especially with the photocathode 11.

When the secondary radiation is light radiation, the layer may be produced by vacuum evaporation of aluminum particles, which tend to reflect the second radiation, or carbon particles, which tend to absorb the second radiation. Other embodiments of the dots 21 of the test pattern 20 are possible, such as a local change in the physical property of the surface of the scintillator 10 in contact with the intermediate layer 32. Specifically, a scintillating substance 36, such as cesium iodide, is deposited on its substrate 35 in the form of a growth of needles. It is possible for example for the tips of the needles to be locally smoothed, in order to locally alter the secondary radiation. Another embodiment consists in physically or chemically modifying one of the components of the entry screen 4. As an example, it is possible to move away from the stoichiometric composition, or crystalline properties may be modified.

In the case of FIG. 4*c*, in which the points 21 of the test pattern 20 are produced between the intermediate layer 32 and the photocathode 11, the dots can alter the secondary radiation. One embodiment consists in the dots having to alter only the electron beam emitted by the photocathode 11, without altering the secondary radiation. The dots 21 therefore modify the gain of the photocathode 11 in the conversion of the energy conveyed by the secondary radiation into electron emission. The photocathode 11 comprises for example a semiconductor material, the composition of which is stoichiometric. The dots 21 may be produced for example by locally moving away from the stoichiometric composition.

The gain of the photocathode 11 may also be modified in a light image intensifier in which the entry screen is shown schematically in FIG. 4*e*. This entry screen does not include a scintillator, and converts the primary radiation directly into electrons. By acting on the gain of the photocathode 11, without altering the primary radiation, the situation is independent of the spectrum of the primary radiation.

It will be readily seen by one of ordinary skill in the art that embodiments according to the present invention fulfill many of the advantages set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

The invention claimed is:

1. An image intensifier electron tube comprising:

an entry screen having a front face and an opposite face, the front face of the entry screen configured to receive primary electromagnetic radiation; and an exit screen for emitting radiation dependent on the primary radiation;

wherein the entry screen includes:

a scintillator on the front face of the entry screen for receiving the primary radiation, the scintillator configured to convert the primary radiation received by the entry screen into secondary radiation;

a test pattern disposed downstream of the scintillator, the test pattern configured to locally alter the secondary radiation output of the scintillator without altering the primary radiation;

a photocathode on the opposite face of the entry screen, the photocathode configured to receive the altered secondary radiation and emit an electron beam in the tube toward the exit screen.

2. The tube as claimed in claim 1, wherein the test pattern is permanently present on the entry screen.

3. The tube as claimed in claim 1, wherein the test pattern is configured to linearly modify a primary radiation/secondary radiation transfer function.

4. The tube as claimed in claim 1, wherein the test pattern is semitransparent to the secondary radiation.

5. The tube as claimed in claim 1, wherein the entry screen further comprises an intermediate layer between the scintillator and the photocathode, the intermediate layer forming the test pattern.

6. The tube as claimed in claim 5, wherein the intermediate layer is configured to absorb the secondary radiation.

7. The tube as claimed in claim 5, wherein the intermediate layer is configured to reflect the secondary radiation.

8. The tube as claimed in claim 5, wherein the scintillator comprises a substrate and a scintillating substance deposited on the substrate and wherein the intermediate layer is placed on the substrate.

9. The tube as claimed in claim 1, wherein the test pattern is configured to modify the gain of the photocathode.

10. The tube as claimed in claim 9, wherein the test pattern comprises a stoichiometry modification of a material of the photocathode.

11. The tube as claimed in claim 1, wherein the test pattern comprises a plurality of dots and the tube further comprises means for analyzing the distribution of the plurality of dots in an image received by the exit screen.

12. The tube as claimed in claim 1, further comprising means for producing a photocathode light offset.

13. The tube as claimed in claim 1, wherein the test pattern comprises a plurality of uniformly distributed dots.

14. An image intensifier electron tube comprising:

an entry screen having a front face and an opposite face, the front face of the entry screen configured to receive primary electromagnetic radiation; and an exit screen for emitting radiation dependent on the primary radiation;

wherein the entry screen includes:

a scintillator on the front face of the entry screen for receiving the primary radiation, the scintillator configured to convert the primary radiation received by the entry screen into secondary radiation;

a photocathode on the opposite face of the entry screen, the photocathode configured to emit an electron beam in the tube toward the exit screen; and an intermediate layer between the scintillator and the photocathode, the intermediate layer having a test pattern disposed thereon comprising a plurality of uniformly distributed dots configured to locally alter the secondary radiation output of the scintillator without altering the primary radiation;

wherein the photocathode is configured to receive the altered secondary radiation.

* * * * *